US010384757B2

(12) United States Patent
Mueller et al.

(10) Patent No.: US 10,384,757 B2
(45) Date of Patent: Aug. 20, 2019

(54) DEVICE FOR PREDETERMINING THE DRIVING STAGE OF AN ELECTRIC MOTOR OF A BOAT

(71) Applicant: Torqeedo GmbH, Gilching (DE)

(72) Inventors: Moritz Mueller, Olching (DE); Christian Conrads, Tutzing (DE); Frank Despineux, Wessling (DE)

(73) Assignee: Torqeedo GmbH, Gilching (DE)

( * ) Notice: Subject to any disclaimer, the term of this patent is extended or adjusted under 35 U.S.C. 154(b) by 0 days.

(21) Appl. No.: 15/811,506

(22) Filed: Nov. 13, 2017

(65) Prior Publication Data

US 2018/0134363 A1 May 17, 2018

(30) Foreign Application Priority Data

Nov. 14, 2016 (DE) ..... 10 2016 121 740

(51) Int. Cl.
*B63H 21/21* (2006.01)

(52) U.S. Cl.
CPC ..... *B63H 21/213* (2013.01)

(58) Field of Classification Search
CPC . B63H 21/213; B63H 23/08; B63H 2021/216
See application file for complete search history.

(56) References Cited

U.S. PATENT DOCUMENTS 3,994,254 A * 11/1976 Woodfill ..... B63H 11/00 440/1
4,632,232 A 12/1986 Kolb et al.
5,233,525 A * 8/1993 Overmann ..... F16H 59/02 477/123
6,202,776 B1 * 3/2001 Masberg ..... F02B 67/04 180/65.22
6,942,530 B1 * 9/2005 Hall ..... B63H 21/213 440/1
8,888,544 B1 11/2014 Guglielmo
9,224,254 B2 * 12/2015 Kuga ..... G07C 5/0816
2003/0188594 A1 * 10/2003 Levin ..... F16H 59/044 74/473.12
2009/0047848 A1 2/2009 Gai et al.
2011/0294373 A1 12/2011 Kuriyagawa
2018/0134362 A1 * 5/2018 Despineux ..... B63H 21/213

FOREIGN PATENT DOCUMENTS

JP 6-115496 A 4/1994

OTHER PUBLICATIONS

German Office Action issued in German counterpart application No. 10 2016 121 740.9 dated Sep. 25, 2017 (Seven (7) pages).
European Search Report issued in European counterpart application No. 17201575.2—1015 dated Mar. 23, 2018, with Statement of Relevancy (Nine (9) pages).

* cited by examiner

*Primary Examiner* — S. Joseph Morano
*Assistant Examiner* — Jovon E Hayes
(74) *Attorney, Agent, or Firm* — Crowell & Moring LLP

(57) ABSTRACT

A device for predetermining the driving stage of an electric motor of a boat is disclosed. A base plate is connected to a side wall of the boat and to a control lever, which is pivotable relative to the base plate about a pivot axis. The control lever is in turn coupled to a speed controller for controlling the motor. The control lever forms a substantially closed contour with a plane formed by the base plate.

20 Claims, 2 Drawing Sheets

DEVICE FOR PREDETERMINING THE DRIVING STAGE OF AN ELECTRIC MOTOR OF A BOAT

CROSS REFERENCE TO RELATED APPLICATIONS

This application claims priority to German Patent Application No. DE 10 2016 121 740.9, filed Nov. 14, 2016, the disclosure of which is expressly incorporated by reference herein.

FIELD OF THE INVENTION

The present invention relates to a device for predetermining the speed level of a motor of a boat, preferably a remote throttle for predetermining the driving stage of an electric motor installed in sailing boat.

BACKGROUND OF THE INVENTION

It is known to drive boats using an electric motor. Furthermore, it is known to control the speed level of the electric motor by means of a device for predetermining the speed level, wherein the predetermination of the speed level takes place for example by the predetermination of the power or the rotational speed of the electric motor. For predetermination of the speed level by the operator, for example by the helmsman, in principle two different possibilities are known:

In a boat drive constructed as an outboard motor with an electric motor it is known to predetermine the driving stage of the electric motor by means of a rotary grip provided at the end of a tiller mounted directly on the outboard motor. The operator of the outboard motor can then not only predetermine the travel direction but can also control the driving stage of the motor in a known manner by means of the tiller.

Furthermore, it is known to provide a remote throttle device, in which a control lever is provided, which is spaced apart from boat drive to be controlled and by means of which the driving stage of the electric motor can then be controlled. The remote throttle is usually arranged on a control panel of the boat, so that it can be operated simply by a driver, whilst the driver also operates the steering wheel. A remote throttle device is used in particular when the motor is installed inaccessibly in the boat—for example when it is provided as a built-in motor with a shaft drive, as a built-in motor with a Z drive, as a sail drive or as a pod drive. However, a remote throttle device can also be used for controlling an outboard motor.

In sailing boats, such a remote throttle device is usually arranged either on a steering column of the steering wheel or on a wall—typically a side wall or a base region of the cockpit. An arrangement of the remote throttle device in the cockpit is also to be found in particular when the sailing boat has tiller steering and accordingly no steering column is provided.

For control of a boat drive it is also possible to provide a plurality of remote throttle devices which are arranged in different positions on the boat—for example on two different control panels.

In this case remote gas devices are known for predetermining the driving stage of an electric motor of a boat, and have a base plate which can be connected to a side wall of the boat on which a control lever is provided which is pivotable about a pivot axis with respect to the base plate.

During the pivoting movement about the pivot axis the control lever acts on a speed controller—for example in the form of a sensor—by means of which the power electronics unit of the electric motor can be controlled in order in this way to implement the driving stage required by the operator.

In order to be able to predetermine the driving stage of the electric motor and thus to control the movement of the boat, the control lever can be operated by the respective operator. As a rule, the control lever has a shaft part and a gripping part which is spaced apart from the axis of rotation and by which the operator usually grips the control lever by his hand. In this case the gripping part is at a sufficiently large distance from the side wall to enable the operator to completely enclose the gripping part with his hand so that a secure and firm grip is possible.

Due to the known geometric construction of the control lever it can happen that rigging and, in particular, sheets, mooring ropes, lashings or other ropes which are necessary for operating the boat, or also fishing lines, become entangled and/or that people moving about on the boat become caught on the control lever by items of clothing and/or limbs. Furthermore, even if the known control levers are arranged in a region close to the floor or near the knees the danger of injury for the people moving about on the boat increases.

SUMMARY OF THE INVENTION

It is an object of the present invention to provide an improved drive device for predetermining the driving stage of a motor of a boat.

This object is achieved by a device for predetermining the driving stage of a motor of a boat according to the embodiments described herein.

A device for predetermining the driving stage of a motor of a boat, preferably of a sailing boat, is proposed, comprising a base plate which can be connected to a side wall of the boat and a control lever which is arranged on the base plate and is pivotable about a pivot axis, and which is coupled to a speed controller for control of the motor. According to the invention the control lever forms a substantially closed contour with a plane formed by the base plate.

A substantially closed contour is understood here to mean, inter alia, that between the control lever and the plane defined by the base plate no gap occurs which is so large that rigging, clothing or limbs can be caught between the plane defined by the base plate and the control lever. In other words, the control lever and the plane defined by the base plate form an external contour which is substantially closed off with respect to the outer region.

Because the control lever forms a substantially closed contour with a plane formed by the base plate, it is possible to prevent rigging and, in particular, sheets, mooring ropes, lashings or other ropes which are necessary for operating the boat, or fishing lines, from becoming entangled on the control lever or to prevent the people moving about on the boat from becoming caught on the control lever by items of clothing or limbs. Furthermore, as a result the device has a particularly compact construction, so that it can also be arranged in the reduced available space in a cockpit of a smaller sailing boat or of a fishing boat or generally in smaller boats, without the operation of the boat being negatively influenced.

In this case it should be noted that, due to the substantially closed contour of the control lever with the plane formed by the base plate, it is no longer possible for a part of the control lever and in particular a handle region of the control lever to be completely enclosed by the operator's hand. At least in the part of the control lever facing the base plate it is no longer possible for the operator's hand to enclose it. In other words, the haptics and the handling of the operation of the proposed control lever differ significantly from the haptics and handling of conventional control levers, which may be perceived as unusual by the operator. However, the disadvantages which may be perceived due to the improved safety of the proposed device are more than offset. This is then the case when—as in a sailing boat or a fishing boat—the motor is only used rarely and remains switched off for most of the time. Here the advantageous effects are particularly pronounced with respect to preventing sheets and other rigging from becoming caught or entangled whilst sailing or preventing fishing lines from becoming entangled.

The device is preferably constructed in such a way that it can be arranged on a side wall of the boat.

The control lever can be moved and positioned in a region which is delimited by the zero position and a maximum position in which the electric drive is operated in its maximum driving stage.

The control lever is preferably coupled to a speed controller for control of the power electronics unit of an electric motor if the motor of the boat is constructed in the form of an electric motor.

The control lever is preferably coupled to a speed controller for control of an electronic or mechanical carburetor regulation or injection regulation if the motor of the boat is constructed in the form of an internal combustion engine.

The driving stage can be implemented by specifying the rotational speed predetermined by means of the control lever so that, when the predetermined maximum rotational speed is reached in the maximum driving stage, the rated power of the motor, for example the electric motor, is also obtained. On the other hand, if due to a less than optimal design of the drive system—for example due to a propeller having a pitch which is too large—a maximum torque of the electric motor predetermined by the system is reached before the maximum rotational speed predetermined by means of the control lever is reached, the rated power is not reached in the maximum driving position predetermined by the control lever. In such a case the driving stage is then predetermined by the maximum torque predetermined by the system. A maximum torque of the electric motor is usually predetermined in the system, in order to prevent a thermal overloading of the motor and thus damage to the motor.

The driving stage can also be implemented by predetermining the power or predetermining the torque predetermined by means of the control lever.

In a further preferred embodiment, the control lever extends substantially in the region of the base plate with respect to the pivot axis when viewed radially. In the case of a device in such a configuration, independently of the installation position of the device on the boat it is ensured that no parts of the control lever project significantly beyond the base plate. As a result, no loose parts, such as clothing, ropes, sheets or cords can remain caught on the control lever or on parts thereof or become entangled thereby.

If the control lever and the base plate according to a further preferred embodiment only form a small axial gap with respect to the pivot axis, entanglement of ropes or sheets can be prevented particularly reliably. The gap is preferably kept smaller than the diameter of the thinnest rigging used on board the boat, and preferably has a gap width of 0.1 mm to 5 mm, preferably 1 mm to 2 mm.

In other words, an area of the drive lever, for example a handle part, in each position of the drive lever directly abuts against the base plate such that only a marginal gap is formed.

In a preferred further embodiment, the gap is completely closed by a bridging element. In this case the bridging element can be, for example, a low friction element which is made, for example, from a Teflon material, and is pretensioned in the gap closing direction. The bridging element can also be an elastomeric element. Complete closing of the gap is particularly advantageous in the case of fishing boats.

The gap is preferably formed between the base plate and the control lever and is substantially constant over the entire pivoting range of the control lever. Thus, it can be ensured that the substantially closed contour is achieved not only in the neutral position or the zero position of the device but also in all other pivoted positions of the control lever. Thus, even when the electric motor is running it is possible to prevent rigging from catching and even during time-critical maneuvering, for example in the harbor, catching and entangling of rigging can be avoided, so that the safety of the boat can be further increased.

In order to further reduce the danger of rigging becoming entangled on the device, but at the same time to improve the haptics, in a further preferred embodiment the control lever and the outer surface of the base part also form a radial gap. The gap preferably has a size of 1 mm to 50 mm, preferably 5 mm to 20 mm. Thus, on the one hand, safe operation of the control lever is made possible and at the same time the possibility of the aforementioned entangling is reduced.

In a further advantageous embodiment, a base part is arranged non-rotatably on the base plate, wherein the control lever is arranged on the base part and is pivotable relative to the base part about the pivot axis. The base part is particularly preferably constructed so as to be substantially cylindrical, in order to further reduce catching of rigging due to the absence of undercuts.

In a particularly preferred embodiment the control lever has in the region of the base part a cover element which is at least partially conically shaped, and which forms a closed contour together with the base part and the control lever. The risk of catching of the rigging as well as the risk of injury are further reduced by the provision of the conical cover.

In a further preferred embodiment, the control lever has a locking device for locking the control lever in a specific position, preferably in a zero position or neutral position, in which the motor is not supplied with power. In this way it is ensured that the control lever is not moved inadvertently out of the zero position and the motor does not cause corresponding involuntarily acceleration of the boat or run unnoticed, resulting in the state of charge of a battery supplying the electric motor decreasing unnoticed and/or involuntarily or fuel being consumed unnoticed.

In order to provide a particularly compact construction of the device and at the same time to achieve great ease of operation for the operator, in a further preferred embodiment an actuating button for unlocking the locking device is arranged on a side of the control lever facing away from the base plate and the actuating button can be actuated particularly preferably in the direction of the pivot axis.

In a further preferred embodiment, a trim-tilt switch is arranged on the control lever for setting the position of the motor relative to a horizontal pivot axis of the motor. As a result, the position of the drive can be adjusted according to the situation of the boat in the water, so that a propeller or the axis of rotation thereof is positioned substantially horizontally in the water. The thrust generated by the drive unit of the motor then contributes substantially completely to the acceleration of the boat in direction of travel. Furthermore, due to the trim-tilt switch the motor can be lifted out of the water, preferably while the boat is not in use or is at a standstill, in order either to reduce resistance when sailing or to avoid the growth of vegetation when the boat is at a standstill.

In order to achieve a particularly simple and robust construction of the device and to provide ease of operation, the trim-tilt switch can be constructed in the form of a membrane keypad. Moreover, the construction of the device is then particularly compact, since the membrane keypad is only small, preferably 0.5 mm to 5 mm, preferably 1 mm to 2 mm in relation to a base surface on which the trim-tilt switch is arranged.

Alternatively, the trim-tilt switch can also be constructed in the form of a rocker switch.

In a further preferred embodiment, the control lever is provided in a movement regulation unit together with a graphical display unit for graphical presentation of information. As a result, a compact construction can be provided. Thus, it is possible to omit any additional units which would otherwise be necessary in the boat for presentation of information. By means of the graphical display unit it is possible to display, in particular, the speed of the boat, the state of charge of the battery as well as the expected range of the boat, the motor power obtained, and/or error messages from the power electronics unit. The graphical display unit can be, for example, housed in the region of the base plate or of the base part.

Other objects, advantages and novel features of the present invention will become apparent from the following detailed description, taken in conjunction with the accompanying drawings, which illustrate, the principles of one or more preferred embodiments.

DETAILED DESCRIPTION OF THE DRAWINGS

Figure 1:
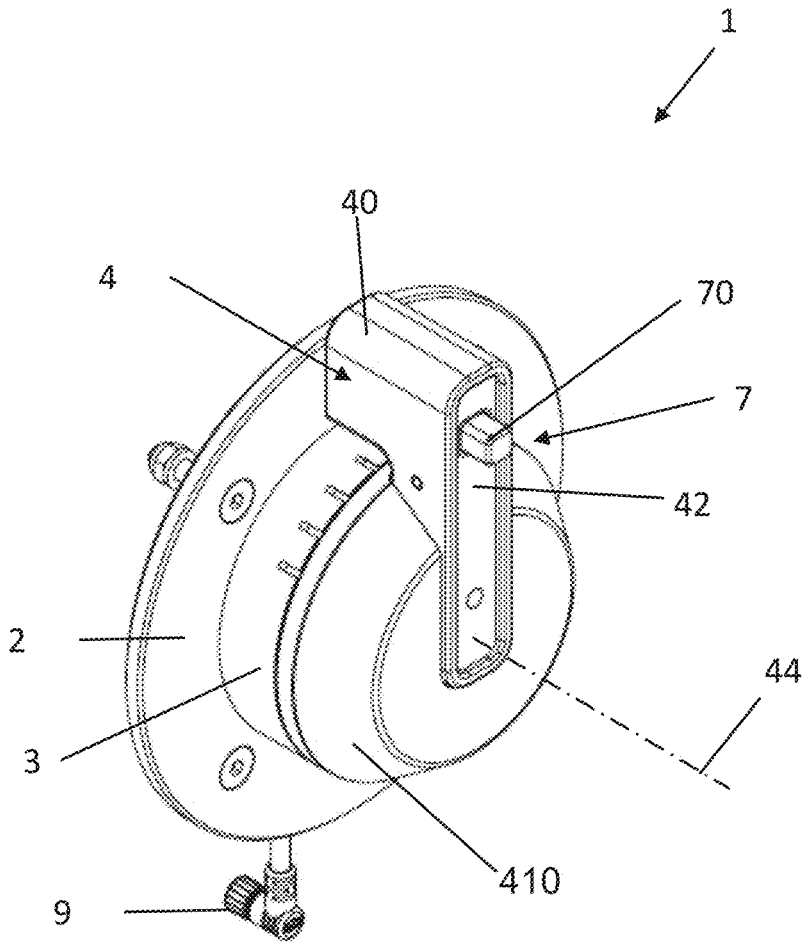
FIG. 1 shows schematically a perspective side view of a device for predetermining the power of an electric motor of a boat.

Exemplary embodiments are described below with reference to the drawings. Those having ordinary skill in the art may be able to make alterations and modifications to what is described herein without departing from its spirit and scope. While the disclosed invention is susceptible of embodiment in many different forms, there is shown in the drawings and will herein be described in detail at least one preferred embodiment of the invention with the understanding that the present disclosure is to be considered as an exemplification of the principles of the invention and is not intended to limit the broad aspect of the invention to the embodiment illustrated. Therefore, it should be understood that what is illustrated is set forth only for the purposes of example and should not be taken as a limitation on the scope of the present invention. In this case elements which are the same, similar, or act in the same way are provided with identical reference numerals in the different drawings, and repeated description of some of these elements is omitted in order to avoid redundancies.

FIG. 1 shows schematically a perspective side view of a device 1 for predetermining the driving stage of an electric motor of a boat. The device 1 has a base plate 2 which can be connected to a side wall of the boat. A substantially cylindrical base part 3 is provided on the base plate 2. A control lever 4 which is pivotable about a pivot axis 44 relative to the base part 3 is arranged on the side of the base part 3 facing away from the base plate 2. The control lever 4 extends radially beyond the base part 3 with respect to the axis of rotation 44 and forms a gripping part 40 on which an operator can grip the control lever 4. The control lever 4 and a plane formed by the base plate 2 form a substantially closed contour, so that rigging, clothing, limbs or the like cannot catch or become entangled behind the control lever 4.

In the illustrated exemplary embodiment, the control lever 4 hardly extends beyond the base plate 2 with respect to the pivot axis 44 when viewed radially. Thus, the substantially closed contour is formed by the base plate 2, the base part 3 and the control lever 4.

In the illustrated exemplary embodiment, the base plate 2 is circular, but can also have a different shape. Due to the circular form of the base plate the geometric relationships between the control lever 4 and the base plate 2 are not changed over the entire pivoting range of the control lever 4.

Furthermore, a locking device 7 is provided on the control lever 4 for locking the control lever 4 in its zero position. In order to release the locking device, the control lever 4 has on its side facing away from the base plate 2 an actuating button 70 for unlocking the locking device 7.

The device 1 can be connected by means of a connection 9 to a power electronics unit of the electric motor for which the speed level is to be predetermined by means of the device 1. This speed level is predetermined by means of a speed controller, which is connected to the control lever 4, by pivoting of the control lever 4 into a corresponding travel position. The speed controller may be designed, for example, in the form of a potentiometer, a Hall effect sensor or another sensor, by means of which a desired journey of the operator can be determined from the position of the control lever 4 relative to base plate 2.

The driving stage can be implemented by specifying the rotational speed predetermined by means of the control lever so that, when the predetermined maximum rotational speed is reached in the maximum driving stage, the rated power of the electric motor is also obtained. The driving stage can also be implemented by specifying the power or specifying the torque predetermined by means of the control lever.

The speed controller is preferably arranged in the base part 3, so that a configuration can be achieved which saves as much installation space as possible.

Furthermore, the control lever 4 has a conically shaped cover element 410 which forms a connection between the control lever 4 and the cylindrical base part 3 and which enables secure and safe covering and connection of the control lever 4 to the base part 3.

Figure 2:
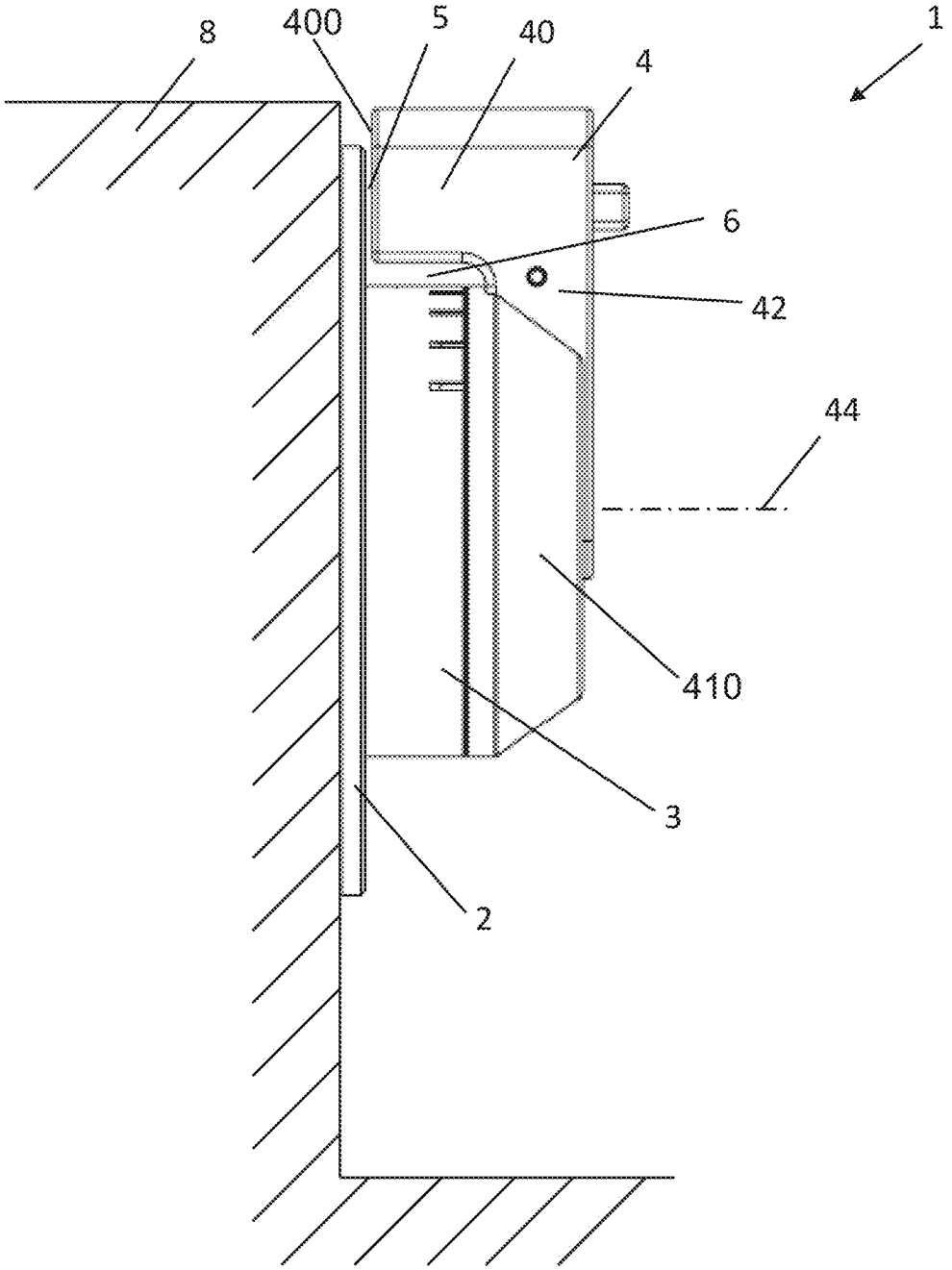
FIG. 2 shows schematically a side view of the device according to FIG. 1 in an installed state on a side wall of a boat.

FIG. 2 shows schematically a side view of the device 1 according to FIG. 1 in an installed state on a side wall 8 of a boat. In this case the device 1 is rigidly fastened with its base plate 2 to the side wall 8 and in the interior of the boat the connector 9 is connected to the power electronics unit of the electric motor to be controlled.

The control lever 4 and the base plate 2 form an axial gap 5 with respect to the pivot axis 44. Therefore, the gripping part 40 or a front face 400 of the control lever 4 lies directly opposite the base plate 2 with a small spacing.

Furthermore, the control lever 4 and the outer surface of the base part 3 form a radial gap 6 with respect to the pivot axis 44. In this case the radial gap 6 extends substantially between the gripping part 40 and the base part 3. Accordingly, a shaft part 42 of the control lever 4 is particularly short.

Therefore, the device 1 shown in FIGS. 1 and 2 is of particularly compact construction and accordingly is particularly suitable for use in boats in which only a small amount of pace is available for the device 1, or in an arrangement of the device 1 in the region of the boat close to the base region of the boat, as is the case in particular with sailing boats or fishing boats.

In the illustrated exemplary embodiments in FIGS. 1 and 2 reference has been made to the control of an electric motor. However, the control by means of the device 1 can likewise be provided for an internal combustion engine, wherein the pivotable control lever 4 is then coupled, for example to a speed controller for controlling an electronic or mechanical carburetor regulation or injection regulation.

As far as practicable, all individual features which are set out in the exemplary embodiments can be combined with one another and/or exchanged for one another, without departing from the scope of the invention.

The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The foregoing disclosure has been set forth merely to illustrate the invention and is not intended to be limiting. This disclosure is thus meant to be understood to include what is specifically illustrated and described above, what is conceptually equivalent, what can be obviously substituted, and also what incorporates the essential ideas. Since modifications of the disclosed embodiments incorporating the spirit and substance of the invention may occur to persons skilled in the art, the invention should be construed to include everything within the scope of the appended claims and equivalents thereof.

The scope of this description is indeed to be interpreted in conjunction with the appended claims and the claimed subject matter is what is intended to be patented.

LIST OF REFERENCE NUMERALS

1 device
2 base plate
3 base part
4 control lever
40 handle region
42 shaft part
44 pivot axis
400 end face
410 cover element
5 axial gap
6 radial gap
7 locking device
70 actuating button
8 side wall
9 connector

What is claimed is:

1. A device for predetermining the driving stage of a motor of a boat, comprising: a base plate configured to connect to a side wall of the boat; and a control lever pivotable relative to the base plate about a pivot axis, the control lever coupled to a speed controller for control of the motor, wherein the control lever forms a substantially closed contour with a plane formed by the base plate, such that, between the control lever and the plane defined by the base plate, no gap occurs that allows rigging, clothing or limbs to be caught between the plane defined by the base plate and the control lever.

2. The device of claim 1, wherein the control lever extends substantially into the region of the base plate with respect to the pivot axis when viewed radially.

3. The device of claim 2, wherein the control lever and the base plate form an axial gap in the direction of the pivot axis.

4. The device of claim 3, further comprising:
a base part fastened on the base plate, the control lever being arranged on the base part so as to be pivotable about the pivot axis relative to the base part.

5. The device of claim 2, further comprising:
a base part fastened on the base plate, the control lever being arranged on the base part so as to be pivotable about the pivot axis relative to the base part.

6. The device of claim 1, wherein the control lever and the base plate form an axial gap in the direction of the pivot axis.

7. The device of claim 6, further comprising:
a base part fastened on the base plate, the control lever being arranged on the base part so as to be pivotable about the pivot axis relative to the base part.

8. The device of claim 7, wherein the control lever and the outer surface of the base part form a radial gap.

9. The device of claim 7, wherein the control lever has a conically shaped cover element.

10. The device of claim 1, further comprising:
a base part fastened on the base plate, the control lever being arranged on the base part so as to be pivotable about the pivot axis relative to the base part.

11. The device of claim 10, wherein the control lever and the outer surface of the base part form a radial gap.

12. The device of claim 11, wherein the control lever has a conically shaped cover element.

13. The device of claim 1, wherein the control lever includes a locking device for locking the control lever in a predetermined position in which the motor stands still.

14. The device of claim 13, wherein the control lever includes an actuating button for unlocking the locking device, the actuating button being arranged on a side of the control lever facing away from the base plate.

15. The device of claim 1, wherein the control lever includes a trim-tilt switch for setting the position of the motor relative to a horizontal pivot axis of the motor, the trim-tilt switch being arranged on the control lever as a membrane keypad.

16. The device of claim 1, wherein the control lever is provided in a movement regulation unit together with a graphical display unit for graphical presentation of information.

17. The device of claim 1, wherein the pivotable control lever is coupled to a speed controller for control of a power electronics unit of an electric motor.

18. The device of claim 1, wherein the pivotable control lever is coupled to a speed controller for control of an electronic or mechanical carburetor regulation or injection regulation of an internal combustion engine.

19. The device of claim 1, wherein the control lever extends substantially into the region of the base plate with respect to the pivot axis when viewed radially, wherein the control lever and the base plate form an axial gap in the direction of the pivot axis, and wherein the control lever is formed such that in cross-section perpendicular to the plane formed by the base plate, a cross-sectional area between the base plate and the control lever is substantially completely filled with material of the control lever.

20. The device of claim 3, wherein a gripping part or a front face of the control lever lies directly opposite the base plate.

* * * * *